US010145226B2

(12) United States Patent
Yee et al.

(10) Patent No.: US 10,145,226 B2
(45) Date of Patent: Dec. 4, 2018

(54) STEAM-SOLVENT-GAS PROCESS WITH ADDITIONAL HORIZONTAL PRODUCTION WELLS TO ENHANCE HEAVY OIL / BITUMEN RECOVERY

(71) Applicant: MEG ENERGY CORP., Calgary (CA)

(72) Inventors: Chi-Tak Yee, Calgary (CA); Subramanyam Bharatha, Calgary (CA); William J. McCaffrey, Calgary (CA)

(73) Assignee: MEG ENERGY CORP., Calgary (CA)

( * ) Notice: Subject to any disclaimer, the term of this patent is extended or adjusted under 35 U.S.C. 154(b) by 0 days.

(21) Appl. No.: 15/353,177

(22) Filed: Nov. 16, 2016

(65) Prior Publication Data

US 2017/0138160 A1 May 18, 2017

(30) Foreign Application Priority Data

Nov. 16, 2015 (CA) ..... 2912159

(51) Int. Cl.

| | |
|---|---|
| ***E21B 43/24*** | (2006.01) |
| ***E21B 43/16*** | (2006.01) |
| ***E21B 43/30*** | (2006.01) |
| ***E21B 43/241*** | (2006.01) |
| *E21B 7/04* | (2006.01) |

(52) U.S. Cl.

CPC ..... *E21B 43/2408* (2013.01); *E21B 43/168* (2013.01); *E21B 43/24* (2013.01); *E21B 43/241* (2013.01); *E21B 43/305* (2013.01); *E21B 7/046* (2013.01)

(58) Field of Classification Search

None

See application file for complete search history.

(56) References Cited

U.S. PATENT DOCUMENTS

| | | | | |
|---|---|---|---|---|
| 5,273,111 | A * | 12/1993 | Brannan | E21B 43/2406 166/245 |
| 8,905,132 | B2 * | 12/2014 | Abbate | E21B 43/24 166/250.1 |
| 2003/0000711 | A1 * | 1/2003 | Gutek | E21B 43/168 166/402 |
| 2010/0206555 | A1 * | 8/2010 | Menard | E21B 43/2406 166/245 |

(Continued)

FOREIGN PATENT DOCUMENTS

| | | | |
|---|---|---|---|
| CA | 1130201 | A | 8/1982 |
| CA | 2277378 | A1 | 1/2001 |

(Continued)

OTHER PUBLICATIONS

Butler, R., "The Steam and Gas Push (SAGP)", Journal of Canadian Petroleum Technology, vol. 38, No. 3, pp. 54-61, Mar. 1999.

(Continued)

*Primary Examiner* — Anuradha Ahuja

(74) *Attorney, Agent, or Firm* — Bennett Jones LLP

(57) ABSTRACT

A system and method of production of hydrocarbons, such as heavy oil or bitumen, by injection of steam, solvent and NCG is provided, which combines the benefits of SAGD, VAPEX, and the use of an additional producer, with specific timing specifications for the initiation of solvent injection prior to inter-chamber fluid communication.

10 Claims, 1 Drawing Sheet

(56) References Cited

U.S. PATENT DOCUMENTS

2014/0069641 A1* 3/2014 Kosik ..... C10G 1/04
166/267

FOREIGN PATENT DOCUMENTS

CA 2591498 C 2/2010
CA 2776704 C 11/2014

OTHER PUBLICATIONS

Butler, R.M., Jiang, Q. And Yee, C.-T., "Steam and Gas Push (SAGP)—3; Recent Theoretical Developments and Laboratory Results", Journal of Canadian Petroleum Technology, vol. 39, No. 8, pp. 51-60, Aug. 2000.

Butler, R.M. and Mokrys, I.J., "A new process (VAPEX) for recovering heavy oils using hot water and hydrocarbon vapour", Journal of Canadian Petroleum Technology, vol. 30, No. 1, pp. 97-106, Jan.-Feb. 1991.

Butler, R.M., "Horizontal Wells for the Recovery of Oil, Gas and Bitumen", Petroleum Society Monograph No. 2, Canadian Institute of Mining, Metallurgy & Petroleum, 1994.

* cited by examiner

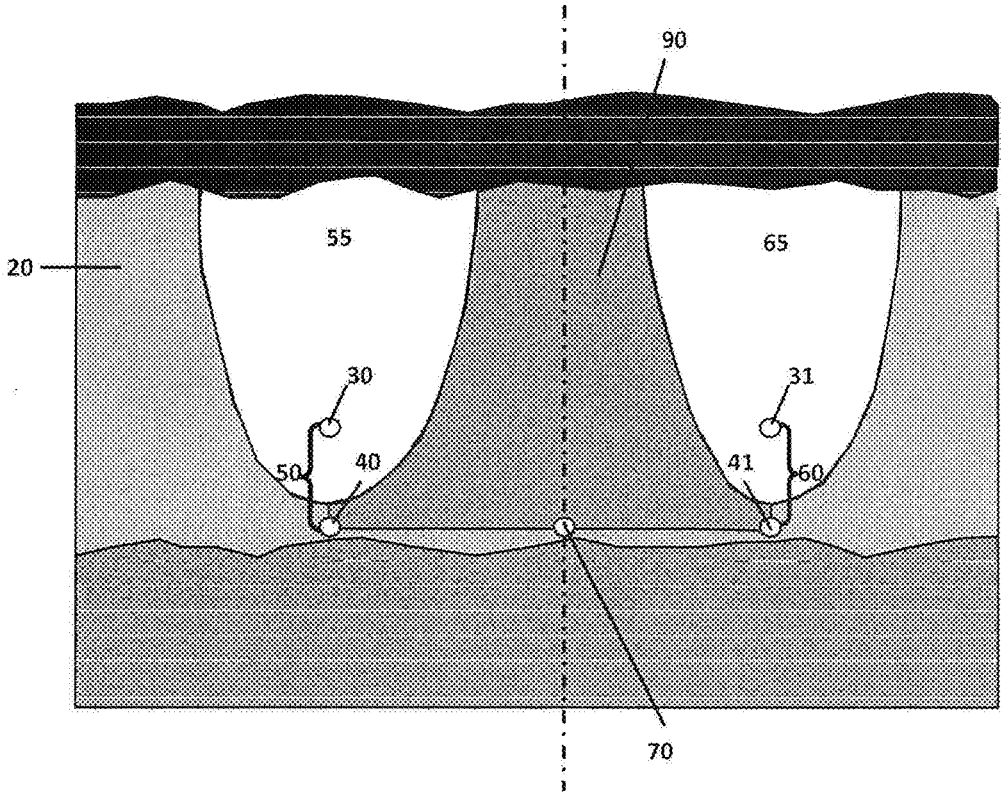
90
55
65
20
30
31
50
40
41
60
70

STEAM-SOLVENT-GAS PROCESS WITH ADDITIONAL HORIZONTAL PRODUCTION WELLS TO ENHANCE HEAVY OIL / BITUMEN RECOVERY

FIELD OF THE INVENTION

This invention is related to the recovery of hydrocarbons such as heavy oil or bitumen from an underground formation (any of which hydrocarbons are referred to here as "Oil"), using a combination of steam-assisted gravity drainage, solvent injection either alone or with steam and/or non-condensable gas, and additional production wells.

PRIOR ART

"Steam-Assisted Gravity Drainage" or "SAGD" is the process commonly employed in commercial projects for hydrocarbon recovery from heavy oil and bitumen deposits. The SAGD process, based on Canadian Patent 1130201, makes use of a pair of essentially parallel horizontal wells, separated by a short vertical distance (typically 4-10 m), to recover immobile oil at initial reservoir conditions. Steam is injected into the oil reservoir continuously from the top horizontal well and the heated oil in the reservoir drains by gravity from the reservoir into the bottom horizontal producer well. During the start-up phase, steam is normally circulated within both wells to heat up the region between the wells and thereby render the oil mobile. Continuous steam injection and production of oil and steam condensate during the SAGD phase results in the formation of a steam chamber, from which most of the oil has drained.

A modification of SAGD to improve the thermal efficiency of the process was suggested by Butler[1]. Consider SAGD carried out at a (nearly) constant steam chamber pressure. The entire steam chamber has to be maintained at the high temperature corresponding to the chamber pressure (typically 200 to 250° C.) by steam injection. Butler's idea was to reduce the temperatures in the top portion of the chamber, but maintain the high temperature near the SAGD well pair in order to minimize the tendency for gas coning into the producer. This may be accomplished by co-injection with steam of a small quantity (typically less than 1 mole percent) of non-condensable gas, typically natural gas which is readily available in the field, but also nitrogen, methane, or any other non-condensable gas (collectively, "NCG"). He called the modified process "Steam and Gas Push" or "SAGP". Unlike steam, the NCG can travel large distances (since it does not condense) and convey the pressure of the steam/NCG chamber, thereby providing pressure support and facilitating gravity drainage of oil.

The NCG accumulates near the top of the chamber and reduces the partial pressure of steam. This results in temperature reduction (as compared to SAGD) in the region of NCG accumulation. This NCG and steam mixture provides some insulation near the top of the reservoir which in turn reduces heat losses to the overburden.

As originally conceived by Butler[1], in SAGP the NCG co-injection begins at the initiation of the production process, immediately following the initial steam circulation period. NCG fingers quickly move to the top of the pay zone during the chamber rise period. The pressure support provided by the fast-moving NCG tends to increase the oil flow rate by accelerating the gravity drainage process. At the same time, the colder temperatures in the top region for SAGP tend to decrease the oil flow rate. Based on laboratory results (as shown in FIG. 14 on p. 57 of Reference 2), in the chamber rise period the production rates for SAGP are approximately the same as for SAGD with reduced steam requirements. However, once the chamber reaches the top of the reservoir, there is a risk that the SAGP oil rates could become progressively lower as compared to SAGD.

SAGP was modified in Canadian Patent 2776704. The process was called "enhanced Modified SAGP" or "eMSAGP" and included additional producers. eMSAGP begins in the SAGD mode (no NCG co-injection). After sufficient heat has accumulated in the reservoir region outside the chamber to render the oil phase (being the liquid phase in the reservoir containing Oil) mobile, steam rates are reduced, NCG co-injection begins, and additional producers begin operation. Field experience at MEG Energy's Christina Lake Regional Project has shown that considerable transfer of heat by convection of steam condensate occurs in the reservoir region outside the chamber during the initial SAGD mode, resulting in temperature distributions more uniform than the ones due to the commonly accepted mechanism of heat conduction alone. The convection of heat appears to be due to the movement of water which cannot be readily modeled in reservoir simulation studies. Considerable steam rate reduction has been achieved in eMSAGP by making use of the heat stored in the reservoir and by the use of additional producers operating mainly by pressure drive, with some help from gravity drainage (as the name suggests, SAGD operates by gravity drainage alone).

Steam may be entirely replaced by hydrocarbon miscible solvents, in vapour form, using a SAGD-like arrangement of wells. Typical commercially available solvents are propane, butane, and mixtures such as naphtha and gas condensate which are blended with bitumen as diluent to meet pipe line viscosity specifications. The steam chamber of SAGD is replaced by a solvent vapour chamber which may be hot or cold, depending on the operating pressure of the chamber and the vapour pressure curve of the solvent (for pure solvents). This process is called "Vapour Extraction" or "VAPEX" by Butler and Mokrys[3] (see also p. 194 of Reference 4).

The solvent may also be co-injected with steam, using a SAGD-like arrangement of wells. Solvent concentration in the injection stream may be small (a few mole percent) or large. This process may be called "Solvent-Assisted SAGD" or "SASAGD", and coincides with SAGD for the limiting case of zero solvent injection, and with VAPEX for the limiting case of zero steam injection.

SUMMARY OF THE INVENTION

In one embodiment, the invention comprises a process for production of Oil from a reservoir where steam injection in an initial SAGD production configuration with two or more adjacent well pairs is initiated and continues until the reservoir Oil's viscosity is altered to become mobile, after which the following processes follow, in any order: (i) solvent injection into the reservoir from surface is initiated, the solvent mixing with the mobilized reservoir Oil for production as an oil phase liquid; and (ii) production from the reservoir to surface is done via at least one SAGD producer and an optional additional in-fill producer. It is to be understood that the injection of heat into the reservoir Oil may be economic where the heat injection process is not SAGD or SAGP but is another method of increasing temperature of the reservoir in situ. The process of this embodiment also contemplates, as required, co-injection through an injector of at least one SAGD well pair of additional steam to maintain or increase reservoir temperature and/or co-injection of NCG to increase or maintain reservoir pressure. It is to be understood that the injected amount of one or more of steam, solvent, NCG, heat or pressure is adjusted to optimize reservoir oil phase viscosity and chamber pressure and temperature for efficient production of reservoir Oil to surface.

In a preferred embodiment, an in situ recovery process for Oil in an underground reservoir is used, following these steps: (a) drilling a SAGD well pair with associated steam generation and oil production facilities with facilities for injection of steam, solvent and NCG; (b) drilling a second, essentially parallel and adjacent SAGD well pair at a similar elevation or depth; (c) producing Oil from the well pairs using SAGD process which will induce formation of a chamber until the average temperature of a producible volume of the reservoir in a space adjacent to and outside of the chamber reaches a value which permits reservoir Oil viscosity to change sufficiently that the Oil is mobilizable; and then (d) injecting solvent via a SAGD injector into that part of the reservoir where the Oil is mobilisable, and: as required, injecting into that part of the reservoir: (i) steam to maintain or increase reservoir temperature in or near that space; and/or (ii) a volume of NCG to maintain or increase reservoir pressure. In this embodiment, the processes are all aimed at production of reservoir Oil. In this embodiment, a further step of drilling an additional in-fill producer being essentially horizontal and parallel to at least one SAGD well-pair, at or near to the same elevation as the producer wells in two adjacent SAGD well pairs and roughly equidistant from those two adjacent SAGD well-pairs, and then producing reservoir Oil to surface via this additional in-fill producer, which may be done prior to injection of solvent and may continue at times after the initial solvent injection during the life of the well.

It is not necessary for the steam chambers or the "mobilized zones" in the terminology of Patent 2591498 to merge before commencing additional producer operations. It is also not necessary to achieve hydraulic communication between a steam chamber from the additional producer, created by CSS operations and the chamber from either SAGD well pair as is described in Patent 2277378.

In these embodiments, if the additional or in-fill producer is not producing satisfactorily, it may be stimulated. In each of these embodiments, the temperature in the reservoir Oil in the relevant space is brought to a value sufficient to affect the Oil viscosity there, which for Athabasca bitumen Oil is between 60 and 100° C. In production situations where the Oil is Cold Lake bitumen, the target temperature to mobilise the Oil by affecting the viscosity of the Oil will be between 30 and 70° C.

The present invention makes use of the heat stored in the reservoir to improve the thermal efficiency of SAGD without requiring two adjacent SAGD chambers, to merge. The average temperature in the Oil in the space or region between the adjacent chambers may be estimated from the cumulative Oil production and steam injection. Here, when we use the term "oil phase" we use it to describe the non-aqueous, flowing, liquid phase containing Oil. Oil phase is used to distinguish this liquid from other fluids in the system such as substances which are in a gas phase, for example. As the average temperature of the Oil in the region continues to increase, the viscosity of the initially immobile Oil will be reduced to a point where it is mobile enough to be produced from the additional producer (for example) using methods that are commonly used to produce heavy oil. Being thus mobilized, the Oil is also capable of better mixing with the injected solvent. Since at this stage, the initially immobile Oil is mobile enough to be produced by conventional methods, there is no need to continue steam injection at full rates. Solvent is then injected or co-injected with reduced steam and with or without NCG, to further reduce oil phase viscosity, maintain chamber pressure, and recover the heat stored in the chambers.

The heat recovered by the solvent/NCG/reduced steam injection boils residual water in the chambers and further steam is produced in situ. The in situ generated steam flows to chamber boundaries where it condenses and transfers heat to the Oil. The steam, solvent and NCG in the chamber also provide a pressure drive to push heated solvent-rich oil phase to the additional producer. This combination of viscosity reduction by solvent dissolution, combined with the effect of heat recovery and transfer to the Oil by solvent/NCG/reduced-steam co-injection, and production via the additional producer together results in significant acceleration of the Oil rate (that is, the volume of produced Oil in the oil phase over time from the reservoir), and reductions in steam consumption and CSOR, while maintaining high recoveries similar to or better than SAGD process recoveries. Solvent injection, with or without steam/NCG co-injection, begins when sufficient heat has been stored in the region outside the steam chambers and not from the beginning of the heat injection (for instance, by initial steam injection in a SAGD process).

Of note, the target average viscosity of the Oil in the relevant space is below 10,000 mPa·s. In a preferred embodiment, that target average viscosity of the Oil is below 2,000 mPa·s.

BRIEF DESCRIPTION OF THE DRAWINGS

FIG. 1 (which is not to scale) is a cross-sectional portrayal of a fictional formation on a plane perpendicular to surface and to horizontal well bores in the formation.

DETAILED DESCRIPTION

SAGD may be modified by injecting a solvent, with or without steam/NCG. The SAGD well arrangement may also be modified. Solvent injection is used to decrease the viscosity of the oil phase by the solvent concentration effect, in addition to the decrease of viscosity caused by the temperature increase effect due to steam injection. Solvent/NCG injection is also used to recover the heat stored in the chamber and for pressure maintenance. The timing of injection of solvent, steam and NCG has to be chosen appropriately. A process of this type, without the solvent, is described in Canadian Patent 2776704.

The well system for a preferred embodiment of the process here is a modification of the SAGD system with additional producers. The system consists of two adjacent horizontal and essentially parallel injector-producer well pairs 50, 60, vertically separated by a short distance (typically 4-10 m), of the type used for SAGD, with an additional horizontal production well 70 (referred to as an "additional producer") approximately midway between the well pairs 50, 60 at about the elevation of the adjacent SAGD well pairs' producers 40, 41. It is understood that in the field implementation of the invention, there may be several SAGD well pairs 50, 60 with additional producers 70 approximately mid-way between at least some of the adjacent pairs as part of a planned array of wells. The process here is based on the following two modifications of VAPEX:

1) The first modification is called "Modified VAPEX" or "MVAPEX". In VAPEX, solvent alone is injected in vapour form right from the beginning. In MVAPEX, there is an initial SAGD mode (steam injection only) until the average temperature in the reservoir region 90 outside the chambers is in a range for which the Oil becomes mobile. For typical Athabasca bitumen, this range is 60-100° C. and is realized after 3 to 5 years of SAGD operation. At this stage of the process, solvent injection in vapour form begins with or without steam/NCG, resulting in significantly increased Oil rates and lower CSOR, as compared to SAGD.

2) In the second modification, MVAPEX is further enhanced by incorporating at least one additional producer 70. (More than one additional producer may be deployed within an array of well pairs.) These additional producers 70 capture Oil mainly by pressure drive from the chambers 55, 65 of the adjacent well pairs 50, 60 (with some help from gravity drainage). This is not to be confused with the infill wells capturing bypassed oil by gravity drainage in Patent 2591498 and similar techniques of the prior art. The twice modified process is called "enhanced MVAPEX" or "eMVAPEX".

A preferred embodiment of the process here begins as SAGD (steam injection only), with the additional producers 70 shut in or not present. When the average temperature in the reservoir region 90 outside the chambers reaches values in a range for which the Oil becomes mobile, solvent injection begins in 30, 31 with or without steam or NCG (most commonly, steam injection rates are reduced), and the additional producers 70 begin operation (mainly by pressure drive from the chambers 55 and 65). The injection rates of solvent vapour, steam and NCG are adjusted to maintain chamber pressure, may be variable over time, and are adjusted to maximize efficient production of Oil as part of recovered oil phase liquids. For typical Athabasca bitumen, a target average temperature range for mobilization of the Oil is 60-100° C., which is realized after 3 to 5 years of SAGD operation. When solvent injection of this invention begins after the Oil is mobilized, the viscosity of the Oil (bitumen) in the reservoir region 90, is reduced to a few thousand mPa·s due to heating of this region during the initial SAGD part of the process—the bitumen in this region 90 then has a viscosity similar to that of heavy oil. As the solvent injection proceeds, the solvent dissolves in the oil phase in the region 90, and further reduces the viscosity of the oil phase to values typical for light oil. This diluted and heated oil phase is then drained by the SAGD producers 40, 41 mainly by gravity drainage, and by the additional producer 70 mainly by pressure drive (and some gravity drainage). The Oil production rates during the solvent injection phase of the process here, may be further enhanced by production from the additional producers, and will be considerably higher than the Oil production rates which would be expected to be achieved by continuation of SAGD. Furthermore, because of the pressure support provided by the chamber via injected solvent, with or without co-injection of NCG and/or steam, the Oil production rate from the additional producer is expected to suffer only a mild decline, resulting in a rapid drainage of the Oil in region 90—the expectation is that the time to ultimate recovery is considerably reduced, compared to SAGD alone, without affecting the ultimate recovery. When the ultimate recovery point is reached, injection of solvent and steam may be stopped, and if necessary, NCG injection is continued or initiated to maintain chamber pressure. It should be emphasized that for the process here, steam rates may be reduced or steam may be shutoff completely, once the region 90 becomes hot enough, and solvent injection is initiated from the SAGD injectors 30, 31. Co-injection of NCG is also optional or variable, adjusted to maintain pressure in the chambers.

When the chambers 55, 65 approach the vertical plane A-A midway between the SAGD well pairs, after recovering typically 30-40% of Oil in place above the SAGD producers 40, 41 there is a large amount of heat stored in the chambers 55, 65 and the associated region 90. At this point in time, approximately two thirds of the previously injected heat remains underground for typical SAGD projects that have a CSOR between 2.5 and 3. The stored heat is in most cases divided roughly evenly between the chambers 55, 65 and the region 90 outside the chambers. The average temperature of the Oil in the producible region 90 of the reservoir outside the chamber can reach the point where the Oil's viscosity has been reduced to within producible ranges without the need for further heating of the Oil. These temperatures may be reached well before the chambers 55, 65 around the adjacent well pairs 50, 60 merge or come into fluid communication with each other. For typical Athabasca bitumen, the Oil will be mobile at a viscosity below 2,000 mPa·s which will be achieved at temperatures between about 60° C. and 100° C.

With the Oil warmed and a considerable amount of heat already stored in the reservoir 20, steam injection may be reduced or even stopped, and solvent injection with optional co-injection of NCG may be initiated to accelerate Oil production by maintaining formation pressures and reducing in situ bitumen viscosity by having injected both heat and suitable solvent. The injection rates for each of these substances (solvent, steam, NCG) may be adjusted to maintain suitable chamber pressure. Maintaining chamber pressure is important as it provides the pressure drive for the recovery process.

When solvent injection begins, steam injection is reduced or stopped, and NCG injection is optional. The partial pressure of steam in the chambers 55, 65 falls as the system cools. The heat stored in the rocks, particularly within the core of the chambers 55, 65 where temperature is the highest, is recovered and transferred to water in the pores in the formation, and additional steam is produced there. The in situ generated steam flows to chamber boundaries where it heats the Oil and continues the recovery operation. Significant amounts of stored heat will be systemically extracted from the chambers to maintain the temperature in the adjacent region 90, leading to higher overall thermal efficiency of the production processes over the life of the wells.

To accelerate and increase Oil recovery, an additional producer 70 is placed approximately midway between two adjacent SAGD well pairs 50, 60 at about the elevation of the SAGD producers 40, 41. The producer 70 will likely be in the coolest region of the reservoir from a geometrical perspective. However, it is also a location that should have the full gravity head to aid production. Periodic stimulation of the wellbore 70 may be required to reduce the viscosity of the Oil surrounding the additional producer 70 to maintain reasonable production rates. It is expected that only a limited number of wellbore stimulations will be required, as the average temperature outside the chamber will become high enough to achieve reasonable production rates.

The chamber(s) 55, 65 of one or both adjacent well pairs 50, 60 act(s) as a pressure support for the additional producer 70. Pressure drive from such chamber(s) 55, 65, provided by injected solvent and optionally co-injected NCG and/or steam, combined with gravity drainage, will result in improved Oil production rates and a lower overall CSOR.

A preferred embodiment of this invention is as follows. Initially the two well pairs 50, 60 are operated in the SAGD mode, with the additional producer 70 shut-in. eMVAPEX operations begin when the SAGD chamber(s) 55, 65 has (have) risen to near the top of the pay zone 20 and spread sideways sufficiently so as to render a sufficient volume of adjacent producible Oil in the reservoir region 90 outside the chamber(s) hot enough to be mobile—for typical Athabasca bitumen, the temperature range is 60-100° C. At any given time during the SAGD part of the process, the volume of the chambers 55, 65 (associated with an adjacent well pair 50, 60) may be estimated from the cumulative steam injection volumes and Oil production and associated reservoir parameters, such as initial and residual Oil saturations and porosity. From the volumes of chambers 55, 65 and the drainage volumes associated with the well pairs 50, 60, the average temperature in the region 90 outside the chambers may be estimated from the cumulative steam injection, by assuming that between 20% and 30% of the injected heat is stored in the reservoir region 90 outside the chambers for typical SAGD projects that have a CSOR between 2.5 and 3. This average temperature may also be estimated by setting up a history-matched reservoir simulation model. The decision to begin eMVAPEX may then be based on the estimated average temperature in the reservoir region 90 outside the chamber between the two well pairs—for Athabasca bitumen, this time typically corresponds to 3 to 5 years after the beginning of SAGD. At that point in time, steam injection is reduced or stopped, and solvent and optional NCG injection begins in the SAGD injectors 30, 31. The injection rates of solvent, optional NCG and/or steam are adjusted so as to maintain chamber pressure.

Additional producer 70 operations begin at about the same time as solvent injection. Although at this time the average temperature in the region 90 outside the chamber is high enough for the Oil be mobile, it is possible that the additional producer 70 may be cold. If this is the case, the additional producer wellbore 70 is stimulated for a suitable period of time before commencing production. Multiple wellbore stimulations may be required to achieve reasonable sustained production from the additional producer 70. Wellbore stimulations may be discontinued when sustained production is achieved in the additional producer 70. In the process here, there is no steam chamber surrounding the additional producer 70, at least during the early stages of operation, and the mobile Oil in the reservoir region 90 outside the chambers flows into the additional producer well 70 because of pressure drive from the well pairs' 50, 60 associated chambers 55, 65, and some gravity head—in this respect the process of this invention differs from the processes described in Patents 2277378 and 2591498, which require the formation of conjoined or merged chambers surrounding their associated infill/offset wells, and the merging of at least two steam chambers.

So far, it has not been possible to achieve attractive bitumen production rates in the field using VAPEX with propane as the solvent. Steam-solvent processes have not shown much promise. Poor solvent recovery is a major issue, making the processes economically unattractive. It is expected that high solvent recoveries can be achieved in eMVAPEX due to the pressure drive to the additional producers.

eMVAPEX, being a solvent based process, inherits several further advantages associated with such processes. Under suitable conditions, in situ upgrading of bitumen can occur because of deasphalting, resulting in higher production rates, and a higher price for the product leaving relatively low value asphaltenes unproduced in the formation, and recovering an essentially upgraded oil product. The process also reduces steam consumption and GHG emissions.

Reservoir simulation results indicate that considerable reduction in cumulative steam injected and CSOR may be achieved by eMVAPEX while the Oil production is accelerated due to solvent action, while maintaining high ultimate recoveries similar to SAGD.

REFERENCES

1. Butler, R., "The Steam and Gas Push (SAGP)", Journal of Canadian Petroleum Technology, Vol. 38, No. 3, pp. 54-61, March 1999.
2. Butler, R. M., Jiang, Q. and Yee, C.-T., "Steam and Gas Push (SAGP)—3; Recent Theoretical Developments and Laboratory Results", Journal of Canadian Petroleum Technology, Vol. 39, No. 8, pp. 51-60, August 2000.
3. Butler, R. M. and Mokrys, I. J., "A new process (VAPEX) for recovering heavy oils using hot water and hydrocarbon vapour", Journal of Canadian Petroleum Technology, Vol. 30, No. 1, pp. 97-106, January-February 1991.
4. Butler, R. M., "Horizontal Wells for the Recovery of Oil, Gas and Bitumen", Petroleum Society Monograph Number 2, Canadian Institute of Mining, Metallurgy & Petroleum, 1994.

The above-described embodiments of the invention are provided as examples. Alterations, modifications and variations can be effected to particular portions of these embodiments by those with skill in the art without departing from the scope of the invention, which is solely defined by the claims appended hereto.

What is claimed is:

1. An in situ recovery process for oil in an underground reservoir in an oil bearing formation comprising the steps of:

a. drilling a first well pair which comprises a substantially horizontal first producer wellbore within the oil bearing formation and nearer to the bottom of the oil bearing formation than to the midpoint of the formation's vertical depth, and a substantially parallel first horizontal injector wellbore in the same formation but separated by a vertical distance above the first producer wellbore and located nearer the top of the formation than the first producer wellbore, with associated steam generation and oil production facilities, and with facilities for injection of steam, solvent and Non-Condensable Gas (NCG);

b. drilling a second well pair substantially parallel to the first well pair, with a second producer wellbore at the same elevation within the same formation as the first producer wellbore and offset from the first producer wellbore by a horizontal distance, and with a second injector wellbore at the same elevation within the same formation as the first injector wellbore and offset from the first injector wellbore by the same horizontal distance;

c. producing the oil from the formation around the first and second well pairs by at least:

i. initially heating the oil by continuously injecting the steam into the injector wellbores;

ii. mobilizing the oil by heat from the steam, and draining the mobilized oil by gravity to the producer wellbores;

wherein the steam forms a chamber about and above each of the injector wellbores and;

iii. removing the oil from the formation;

d. continuing production according to step c until:

a) an average temperature of a producible volume of the reservoir outside and adjacent to each of the chambers is increased to a value which permits the reservoir oil in the adjacent volume of the reservoir to be mobilisable; and b) the chambers have extended to the top of the oil bearing formation, and have further extended horizontally at the top of the chambers to thereby conjoin; and e. after step d, injecting the solvent and i. co-injecting the steam to maintain or increase reservoir temperature; and ii. co-injecting the NCG to maintain or increase reservoir pressure via the injector wellbore of at least one of the well pairs; and f. producing the reservoir oil from the producer wellbore of at least one of the well pairs.

2. The process of claim 1, adding at any time the further step of drilling an additional horizontal producer well between and parallel to and at the same elevation within the formation as, and equidistant from, the first and second producer wellbores of the first and second well pairs; and after drilling the additional horizontal producer well, adding after step c but prior to or contemporaneously with the solvent injection of step e, a further step c1:

c1. producing the reservoir oil via the additional horizontal producer well.

3. The process of claim 1, adding at any time the further step of drilling an additional horizontal producer well between and parallel to and at the same elevation within the formation as, and equidistant from, the first and second producer wellbores of the first and second well pairs; and after drilling the additional horizontal producer well and after step e, producing the reservoir oil via the additional horizontal producer well.

4. The process of claim 2, with an added step of stimulating the additional horizontal producer well with steam until production from the additional horizontal producer well is established.

5. The process of claim 3, with an added step of stimulating the additional horizontal producer well with steam until production from the additional horizontal producer well is established.

6. The process of claim 1, wherein the reservoir oil of the producible volume of the reservoir outside and adjacent to each of the chambers around the injector wellbores is brought to a temperature within a range required to alter the viscosity of the reservoir oil to be produced so that the oil is mobilisable.

7. The process of claim 1, wherein the reservoir oil is Athabasca bitumen, and where the average temperature of the reservoir oil of the producible volume of the reservoir outside and adjacent to each of the chambers around the injectors wellbores is brought to between 60 and 100° C.

8. The process of claim 1, wherein the reservoir is Cold Lake bitumen, and where the average temperature of the reservoir oil of the producible volume of the reservoir outside and adjacent to each of the chambers around the injectors wellbores is brought to between 30 and 70° C.

9. The process of claim 1 where, the step of increasing the average temperature in step (d)(a) does not use steam.

10. The process of claim 1 where the injected volume of one or more of: the solvent, steam, or NCG is adjusted to optimize oil phase viscosity, chamber pressure and temperature in situ for production of reservoir oil.

* * * * *